US007186281B2

(12) United States Patent
Cheng

(10) Patent No.: US 7,186,281 B2
(45) Date of Patent: Mar. 6, 2007

(54) DUST-REMOVING DEVICE FOR THE DUST-COLLECTING TANK OF A DUST-COLLECTING MACHINE

(75) Inventor: Chieh yuan Cheng, Taichung (TW)

(73) Assignee: San Ford Machinery Co., Ltd., Taichung (TW)

( * ) Notice: Subject to any disclaimer, the term of this patent is extended or adjusted under 35 U.S.C. 154(b) by 500 days.

(21) Appl. No.: 10/610,814

(22) Filed: Jul. 2, 2003

(65) Prior Publication Data

US 2005/0000055 A1 Jan. 6, 2005

(51) Int. Cl.
*B01D 46/04* (2006.01)

(52) U.S. Cl. ..... 55/289; 55/283; 55/293; 55/294; 55/290; 55/300; 55/295; 55/302; 55/303; 95/278; 95/279; 210/391; 210/393; 210/394

(58) Field of Classification Search ..... 55/289, 55/293, 283, 294, 290, 300, 295, 302, 303, 55/203; 95/278, 279; 210/391, 393, 394
See application file for complete search history.

(56) References Cited

U.S. PATENT DOCUMENTS

| | | | | |
|---|---|---|---|---|
| 399,984 | A * | 3/1889 | Gessl | 55/290 |
| 2,271,401 | A * | 1/1942 | Sainty | 96/288 |
| 3,510,903 | A * | 5/1970 | Stoever et al. | 15/256.5 |
| 5,143,529 | A * | 9/1992 | Means, Jr. | 55/290 |
| 5,584,900 | A * | 12/1996 | Zaiser et al. | 55/293 |
| 5,827,338 | A * | 10/1998 | Horvat | 55/285 |
| 5,922,092 | A * | 7/1999 | Taylor | 55/295 |
| 2005/0081495 | A1* | 4/2005 | Wei et al. | 55/290 |

* cited by examiner

*Primary Examiner*—Minh-Chau T. Pham
(74) *Attorney, Agent, or Firm*—Troxell Law Office, PLLC

(57) ABSTRACT

A dust-removing device for the dust-collecting tank of a dust-collecting machine includes a guide frame installed inside the dust collecting tank and having a central guide rod for a brush base to move up and down thereon. The brush base has its outer circumferential edge provided with numerous brushing bristles able to reach the folded grooves in the inner wall of the dust-collecting tank. A pull unit is provided with plural pulley bases for a pull rope to pass therethrough. Two handles are respectively fixed with two lines of the pull rope exposed to the outer side of the dust-collecting tank, and the pull rope has two ends fastened with the brush base. When the two handles are moved downward alternately and repeatedly, the brush base can be moved up and down to carry out cleaning of the dust-collecting tank.

5 Claims, 10 Drawing Sheets

DUST-REMOVING DEVICE FOR THE DUST-COLLECTING TANK OF A DUST-COLLECTING MACHINE

BACKGROUND OF THE INVENTION

1. Field of the Invention

This invention relates to a dust-removing device for the dust-collecting tank of a dust-collecting machine, particularly to one installed inside the dust-collecting tank and able to conveniently and quickly remove dust adhered therein, unnecessary to remove the dust-collecting tank from a dust-collecting machine.

2. Description of the Prior Art

A conventional dust-collecting machine 10, as shown in FIG. 1, includes a bottom base 11 provided thereon with a blower 12 having a wind-sucking opening 121 and a wind outlet 122, and a dust-collecting base 13 connected with the wind outlet 122 of the blower 12 by a wind duct 14. A dust-collecting bag 15 is fitted under the dust-collecting base 13 and a dust-collecting tank 16 having a permeative function is positioned on the topside of the dust-collecting base 13. When the blower 12 is operated, piping connected with the wind-sucking opening 121 will produce a vacuum sucking force to suck dust into the blower 12, and then the dust will drop into the dust-collecting bag 15 through the wind outlet 122, the wind dust 14 and the dust-collecting base 13. The dust-collecting tank 16 positioned on the dust-collecting base 13 has a main function of air exhausting in the process of dust collection, therefore its exhausting capacity and smoothness greatly influence the effect of dust collection. To increase the exhausting effectiveness of the dust-collecting tank 16, a filter tank 162 made of filter paper is always installed in the in interior of an outer frame 161, having its inner circumferential wall formed with numerous serrated folds so as to enlarge its surface for contacting the outside and increase an extent of wind exhausting. Besides, common filter paper is formed with very fine air-permeating holes, preventing micro dust from exhausted therethrough.

However, such a conventional dust-collecting tank 16 has the following defects.

1. After used for a period of time, the air-permeating holes of the filter tank 162 of the dust-collecting tank 16 will be blocked up by fine dust adhered therein, therefore it is necessary to remove the adhered dust regularly to maintain excellent effect of air exhausting. Since the filter tank 162 has no dust-removing device provided inside, it has to be removed from the dust-collecting base 13 to be cleaned up by cleaning instruments such as an air spraying gun or a brush, and then it is again assembled with the dust-collecting base 13, thus complicating process of dust removal.

2. The filter tank 162 has its inner circumferential wall formed with numerous serrate folds to increase its surface for contacting the outside and among these serrated folds are formed numerous folded grooves 1621, which cause much difficulty in the process of cleaning the filter tank 162.

SUMMARY OF THE INVENTION

The objective of the invention is to offer a dust-removing device for the dust-collecting tank of a dust-collecting machine. The dust-removing device has a guide frame installed inside the dust-collecting tank and a brush base slidably mounted on the guide frame. The brush base has its outer circumference provided with numerous brushing bristles able to be controlled to move up and down to carry out brushing and cleaning. During repetitive moving-up-and-down action, the brushing bristles of the brush base can brush and remove the dust adhered to the inner wall of the dust-collecting tank, unnecessary to remove the dust-collecting tank from the dust-collecting machine.

BRIEF DESCRIPTION OF DRAWINGS

This invention will be better understood by referring to be accompanying drawings, wherein.

DETAILED DESCRIPTION OF THE PREFERRED EMBODIMENT

Figure 1:
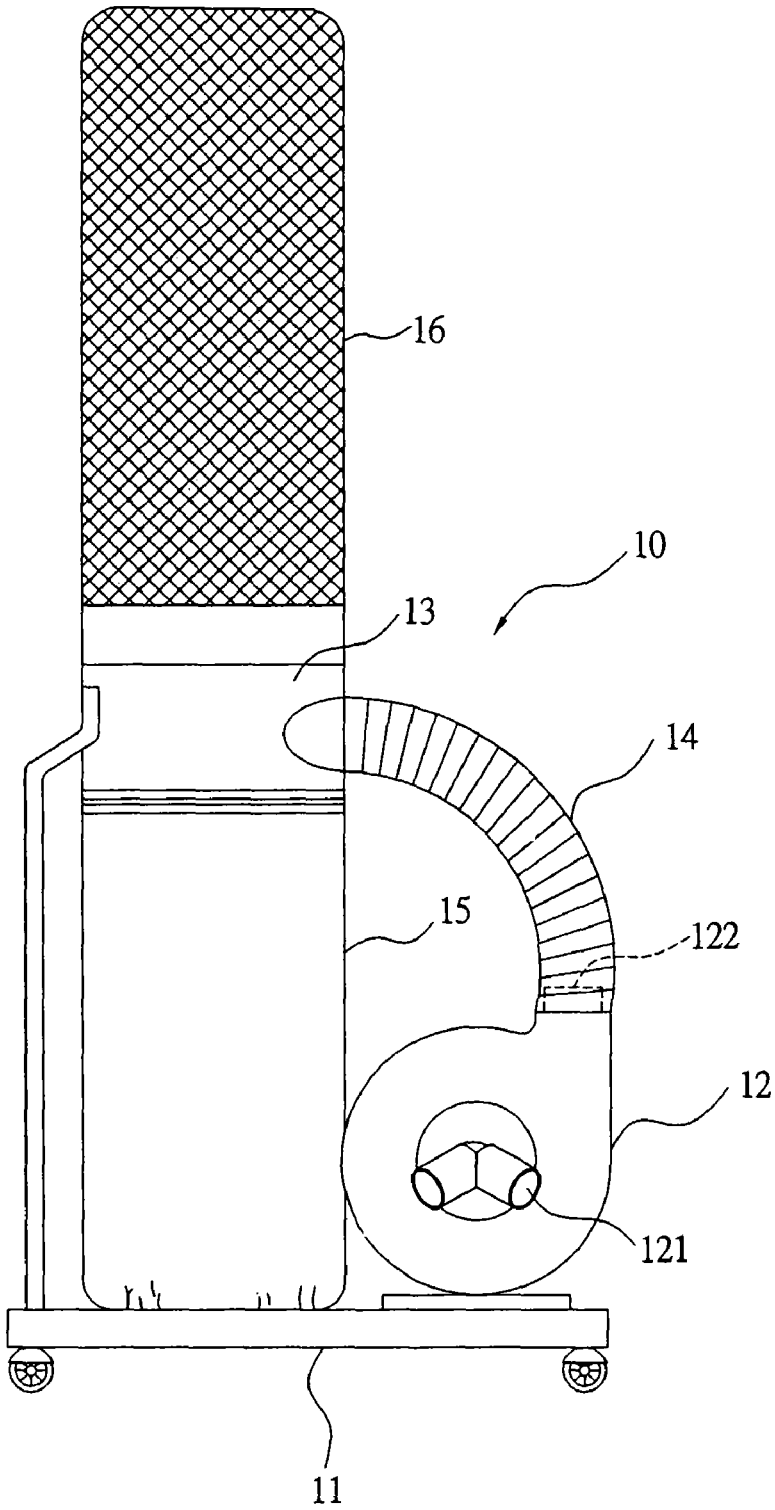
FIG. 1 PRIOR ART
FIG. 1 is a front view of a conventional dust-collecting machine.
Figure 2:
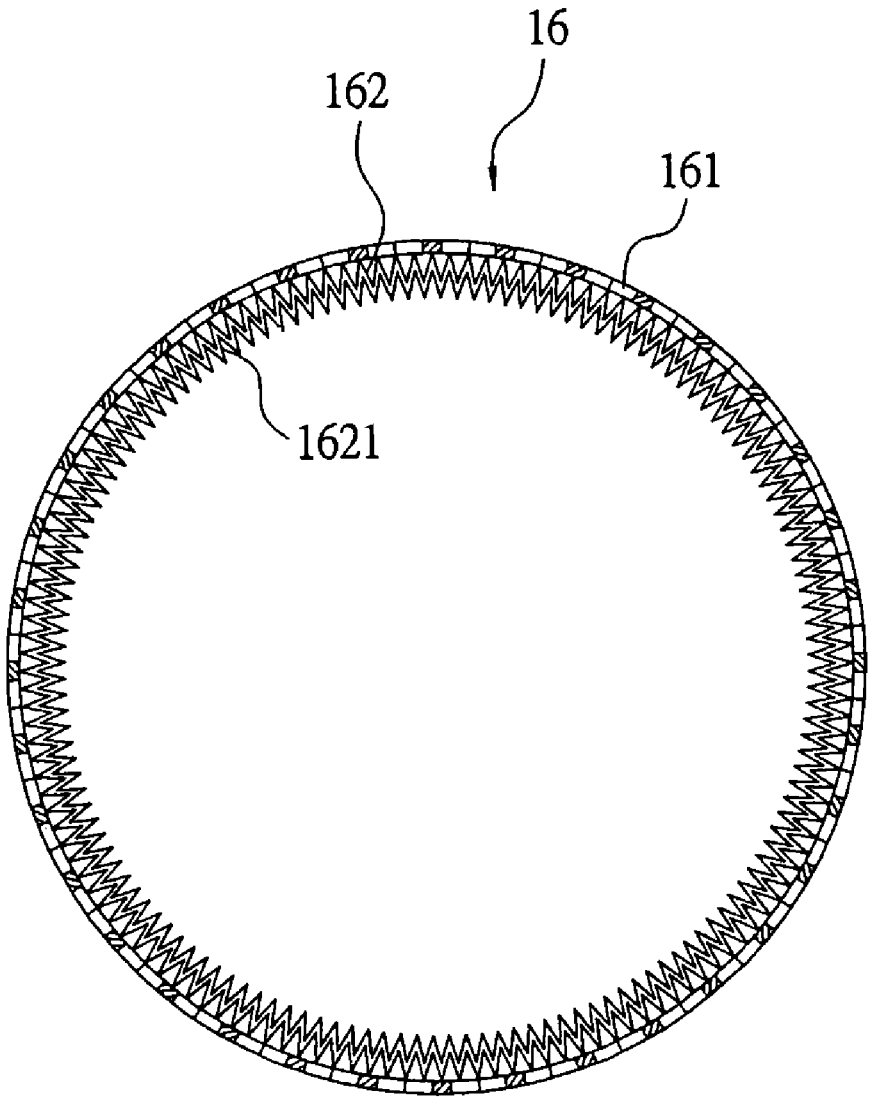
FIG. 2 PRIOR ART
FIG. 2 is an upper cross-sectional view of a conventional dust-collecting tank.
Figure 3:
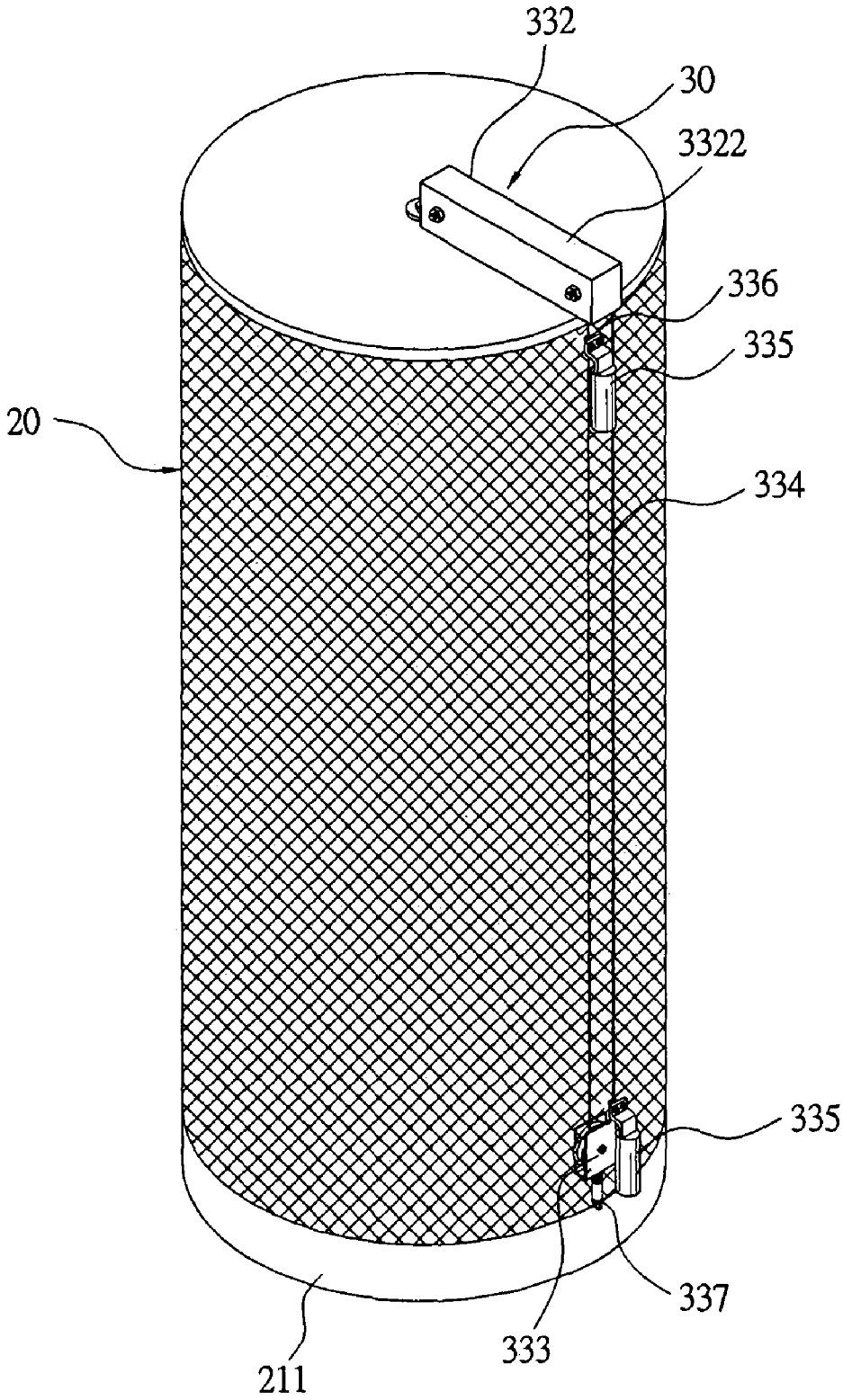
FIG. 3 is a perspective view of the dust-collecting tank of a dust-collecting machine in the present invention.
Figure 4:
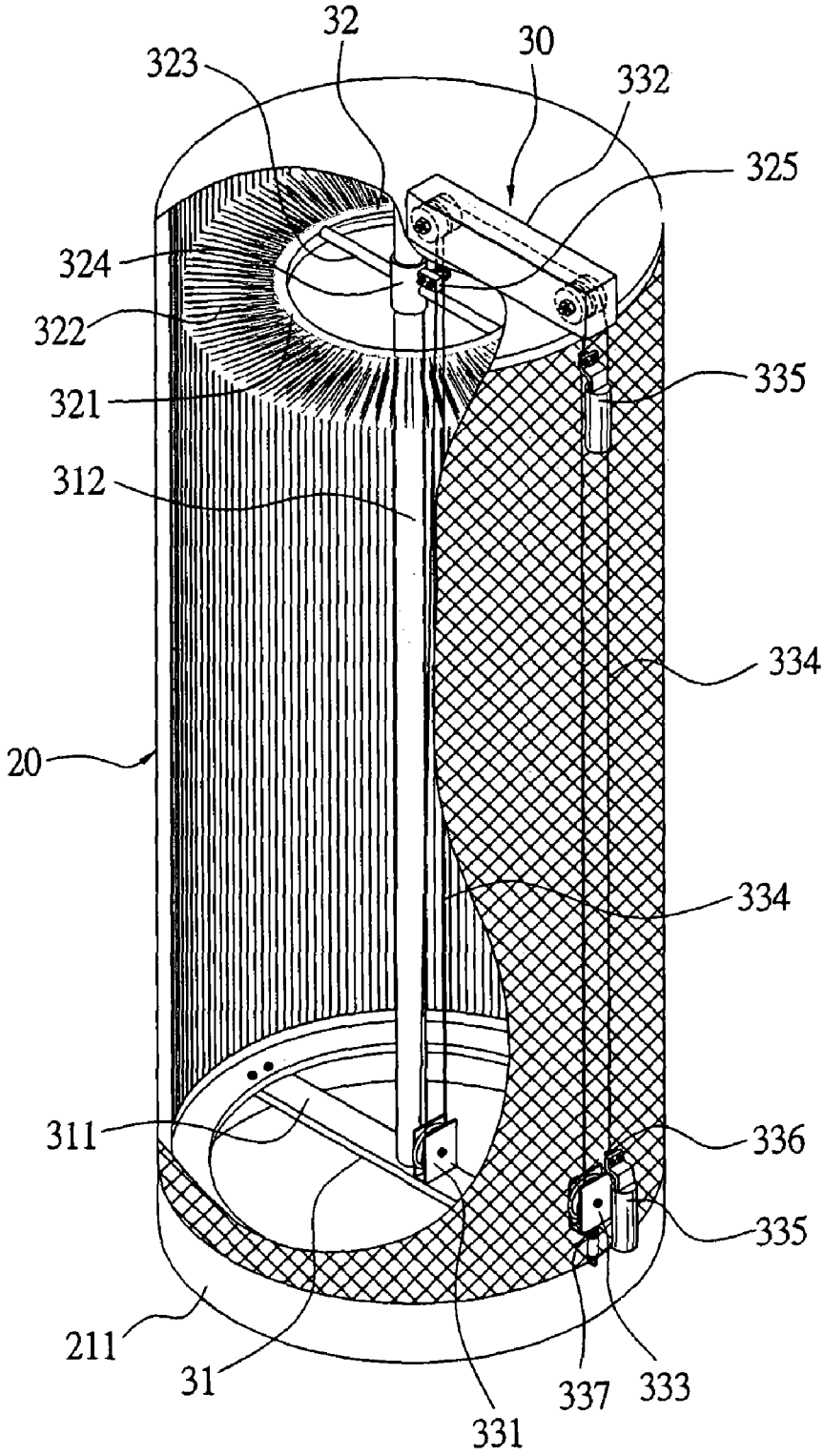
FIG. 4 is a perspective and partial cross-sectional view of a dust-removing device for the dust-collecting tank of the dust-collecting machine in the present invention.

A preferred embodiment of a dust-collecting machine in the present invention, as shown in FIGS. 3 and 4, includes a dust-collecting tank 20 and a dust-removing device 30 combined together.

The dust-collecting tank 20 is composed of an outer frame 21 and a filter tank 22 provided inside the outer frame 21. The filter tank 22 is made integral of filter paper, and the outer frame 21 is a mesh body, having a combining base 211 at the bottom to be mounted on the dust-collecting base (not shown) of the dust-collecting machine. The filter tank 22 has its inner circumferential wall formed with numerous serrated folds among which form numerous conical folded grooves 221.

The dust-removing device 30 includes a guide frame 31, a brush base 32 and a pull unit 33.

The guide frame 31 is composed of a horizontal long supporter 311 and a vertical central guide rod 312. The supporter 311 has its opposite ends respectively fixed at two corresponding sides of the opening of the combining base 211 at the bottom of the dust-collecting tank 20. The central guide rod 312 has its lower end secured at the central portion of the supporter 311 and its upper end fixed at the central portion of the top wall of the dust-collecting tank 20.

The brush base 32 is formed with a ring 321 having its outer circumferential edge provided with numerous brushing bristles 322, which can respectively insert in the folded grooves 221 in the inner wall of the filter tank 22. A support rod 323 is disposed between the opposite edges of the inner wall of the ring 321 and a toggle 324 is fixed at the central portion of the support rod 323 to be fitted around the central guide rod 312 of the guide frame 31 and moved up and down along the guide rod 312, enabling the brushing bristles 321 of the brush base 32 to remove dust from the inner walls of the folded grooves 221.

The pull unit 33 consists of a lower pulley base 331, an upper pulley base 332, an outer pulley base 333, a pull rope 334 and two handles 335. The lower pulley base 331 is fixed on the topside, near the central guide rod 312, of the base supporter 311 of the guide frame 31. The upper pulley base 332 is horizon tally fixed at a preset location on the outer surface of the top wall of the dust-collecting tank 20. The outer pulley base 333 is secured at a preset location at the outer wall of the combining base 211 under the dust-collecting tank 20. The pull rope 334 has its upper end fastened with the toggle 324 and its lower end extending downward to pass through the lower pulley base 331 and then pulled upward to pass through the top wall of the dust-collecting tank 20 and two pulleys of the upper pulley base 332 and then extending downward along the outer wall of the dust-collecting tank 20 to pass through the outer pulley base 333. Subsequently, the pull rope 334 is turned back and moved upward along the original route to pass through the other two pulleys of the upper pulley base 3321 and get into the dust-collecting tank 20 to be fastened with the toggle 322 of the brush base 32. Thus, the pull rope 334 is able to control the brush base 32 to move up and down along the central guide rod 312. The two handles 335 are respectively positioned at an upper and a lower preset location of two lines of the pull ropes 334, which are exposed between the upper pulley base 332 and the outer pulley base 333. By so designing, when the first handle 335 (the upper one) is moved downward, the brush base 32 will be actuated to move downward by the pull rope 334, and synchronously the second handle 335 (the lower one) will be actuated to move to an upper location together with the pull rope 334. At this time, move downward the second handle 335, and the brush base 32 will be actuated to move upward by the pull rope 334. In this operating way, the two handles 335 can alternately control the brush base 32 to move up and down to carry out cleaning of the dust-collecting tank 20.

Figure 5:
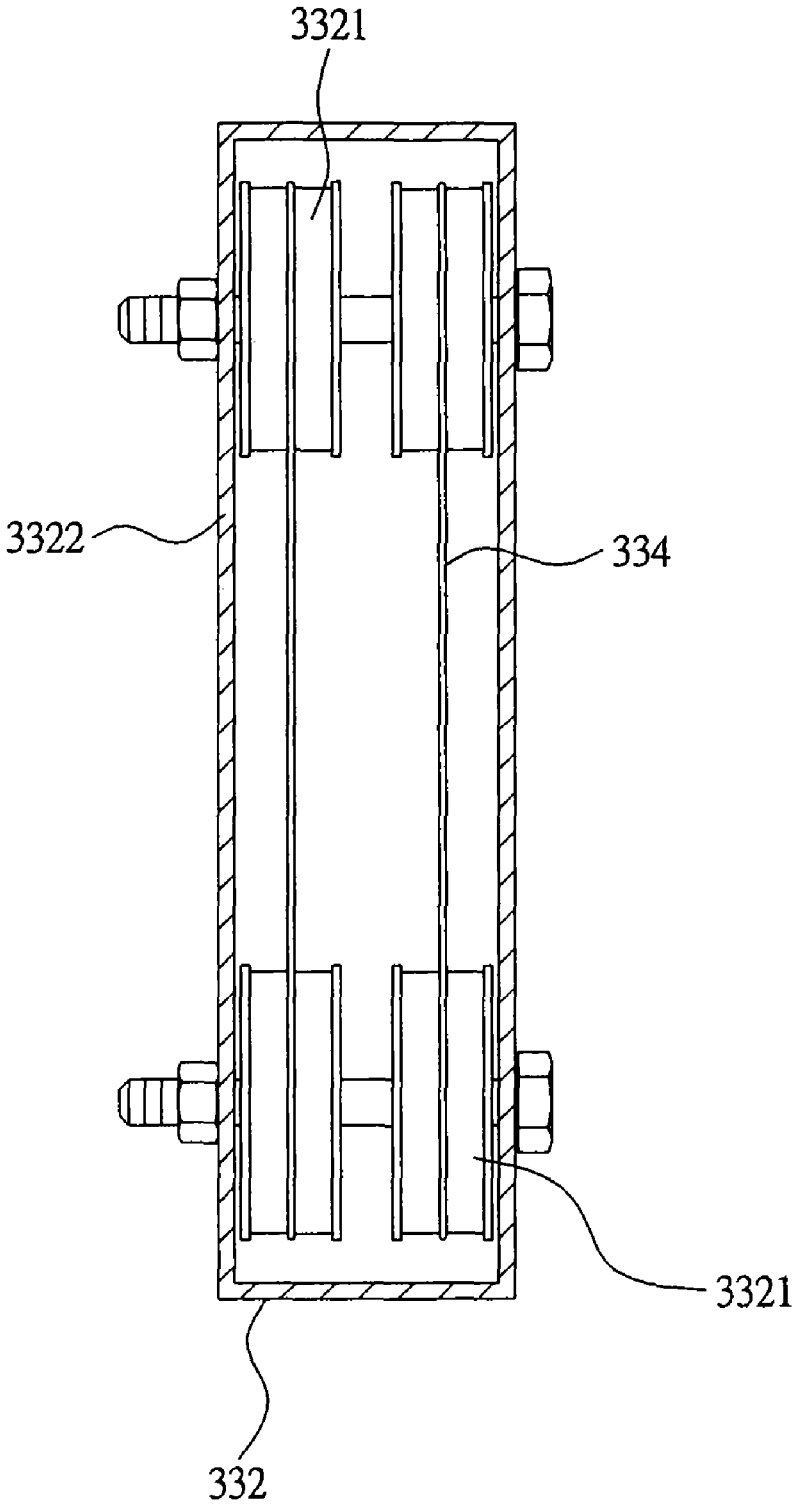
FIG. 5 is a partial upper view of the upper pulley base of the dust-removing device for the dust-collecting tank of the dust-collecting machine in the present invention.
Figure 6:
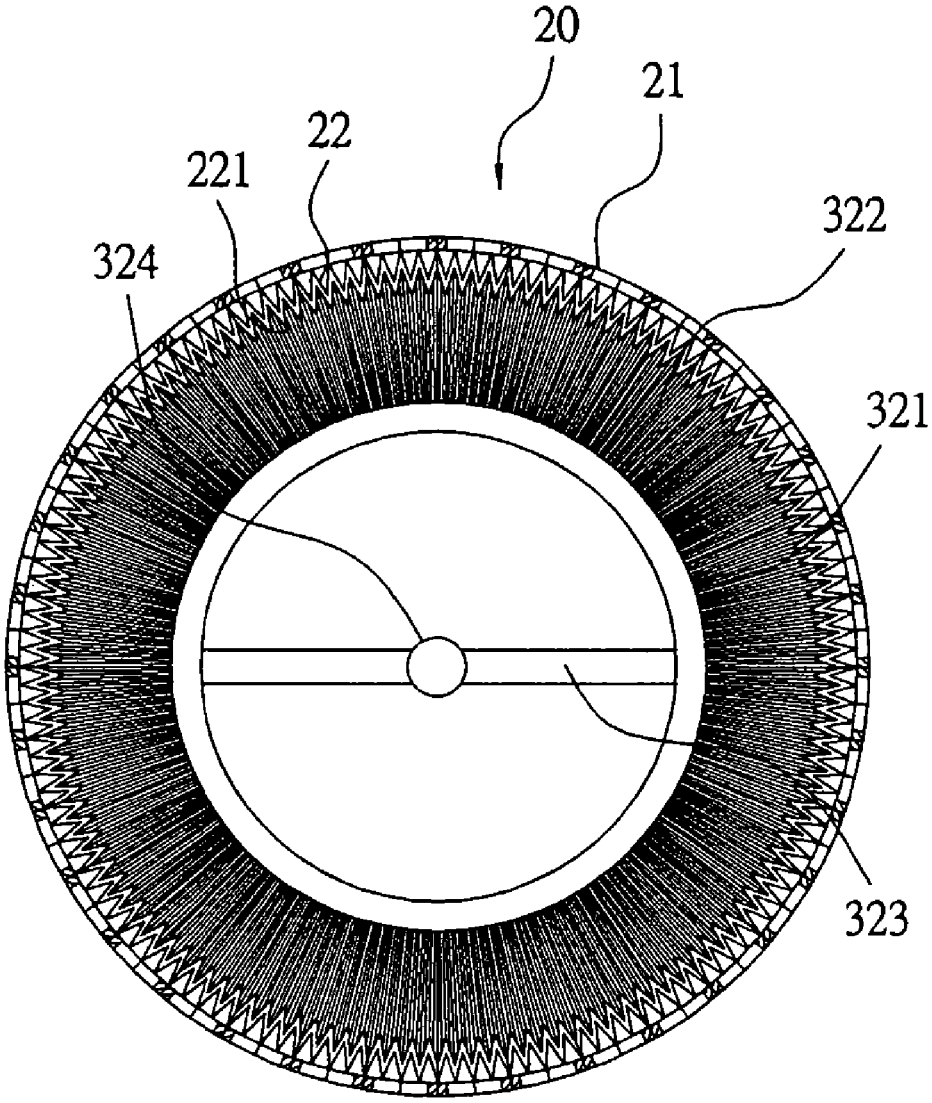
FIG. 6 is an upper view of the dust-collecting tank and the brush base of the dust-removing device in the present invention.

In addition, the lower pulley base 331 and the outer pulley base 333 are respectively provided with only one pulley, while the upper pulley base 332 has two pulley unit 3321 respectively provided at the opposite ends of the rectangular frame 3322 of the upper pulley base 332 and respectively located near the upper central portion and the circumferential edge of the dust-collecting tank 20 for the pull rope 334 to make a turn and pass therethrough. Each pulley unit 3321 of the upper pulley base 332 has two coaxial pulleys respectively rotatable independently, so that the pull rope 334 can be moved back and forth repeatedly through these coaxial pulleys, as shown in FIG. 5.

Figure 9:
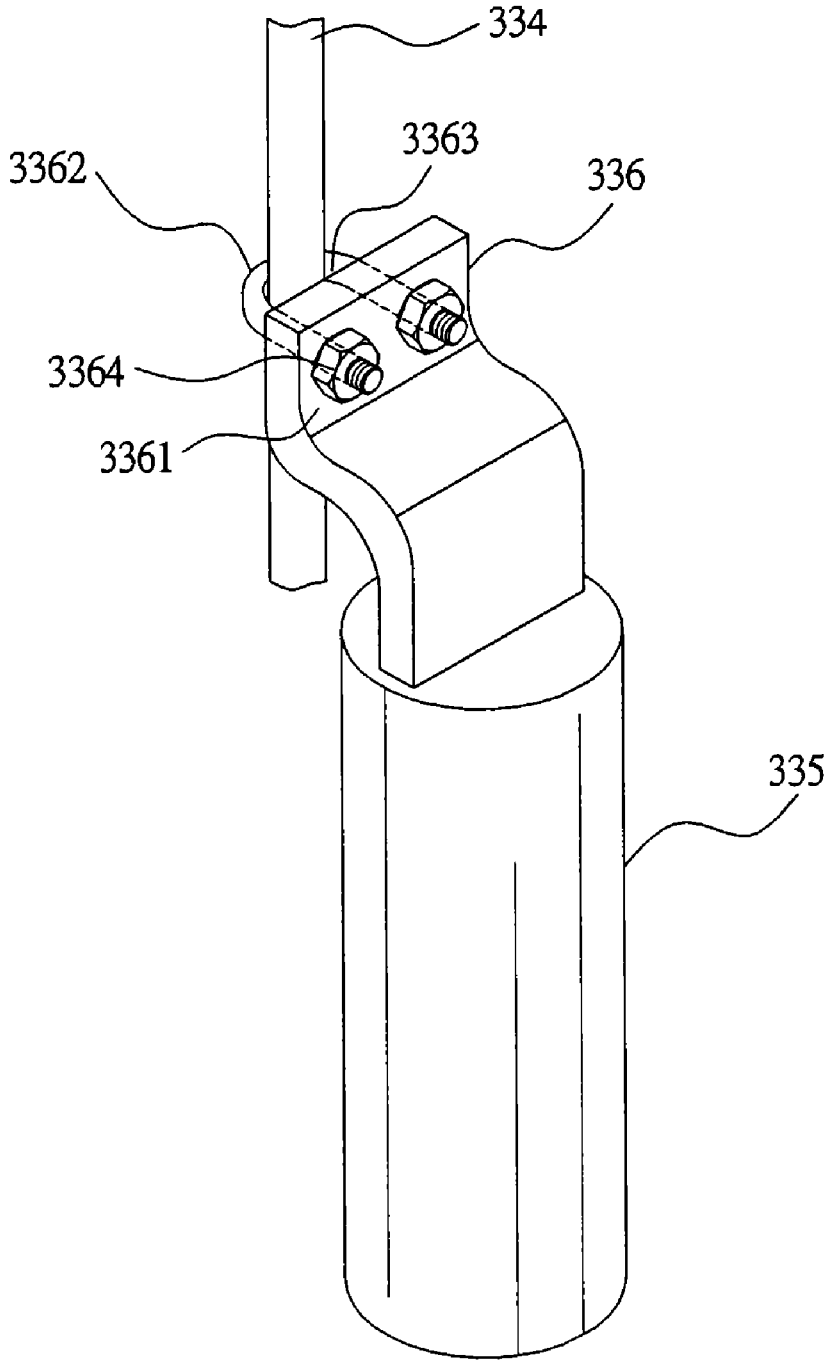
FIG. 9 is a perspective view of the handle and the pull rope of the dust-removing device in a combined condition in the present invention.
Figure 10:
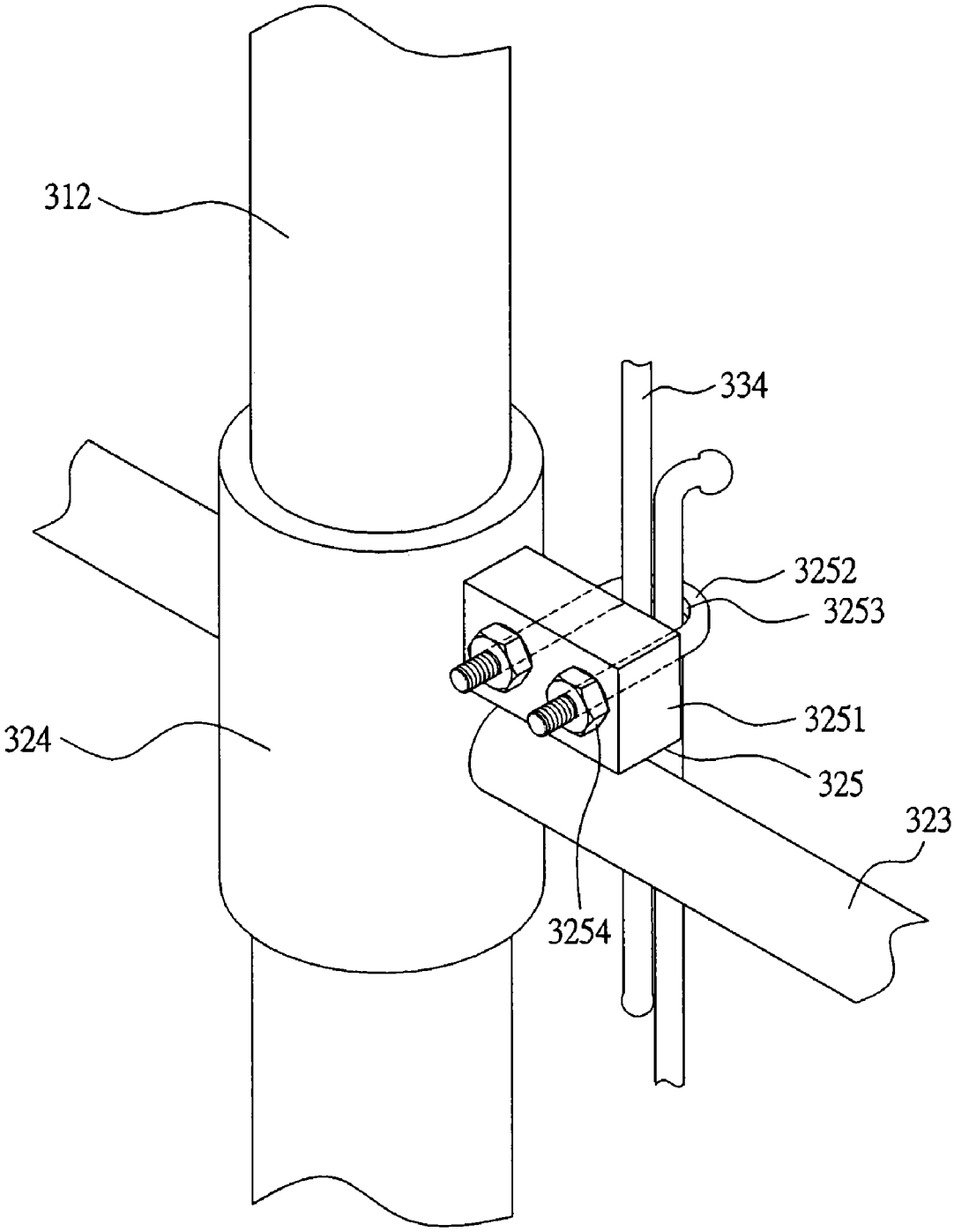
FIG. 10 is a perspective view of the brush base and the pull rope of the dust-removing device in a combined condition in the present invention.

Further, the two handles 335 and the toggle 324 of the brush base 32 are respectively provided with a rope locking base 336, 325 for fastening the pull rope 334 in position, as shown in FIGS. 9 and 10. Each rope locking base 336, 325 includes a locking plate 3361, 3251 respectively secured on the two handles 335 and the toggle 324, and a U-shaped rod 3362, 3252 respectively having the opposite ends inserted through the locking plate 3361, 3251, with an insert hole 3363, 3253 formed between the U-shaped rod 3362, 3252 and the locking plate 3361, 3251. Thus, after inserted through the insert hole 3363, 3253 the rope 334 can be firmly clamped therein by two nuts 3364, 3254 urging and locking tightly the two ends of the U-shaped rod 3362, 3252. In other words, the pull rope 334 is respectively fixed firmly with the two handles 335 and the toggle 324 so as to enable the two handles 335 to actuate the toggle 324 of the brush base 32 to move up and down by pulling the pull rope 334.

Figure 7:
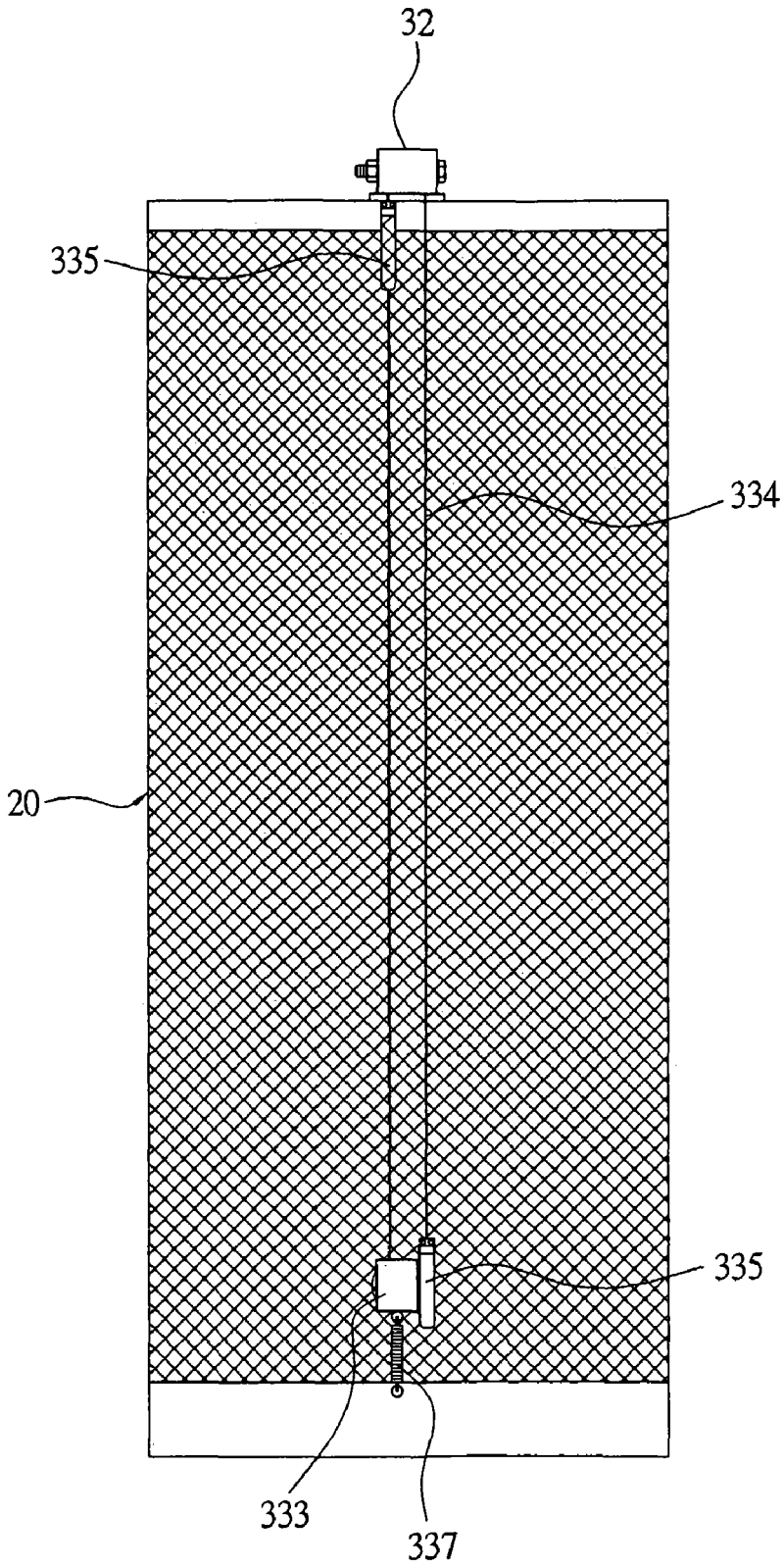
FIG. 7 is a side cross-sectional view of the dust-collecting tank of the dust-collecting machine in the present invention.

Furthermore, an extension spring 337 has its opposite ends respectively hooking the outer pulley base 333 and the combining base 211 under the outer frame 21 of the dust-collecting tank 20 to serve as a buffer for absorbing vibration when the pull rope 334 is pulled up and down by the handle 335, able to prevent the pull rope 334 from slipping off the pulleys due to loosening, as shown in FIG. 7.

Figure 8:
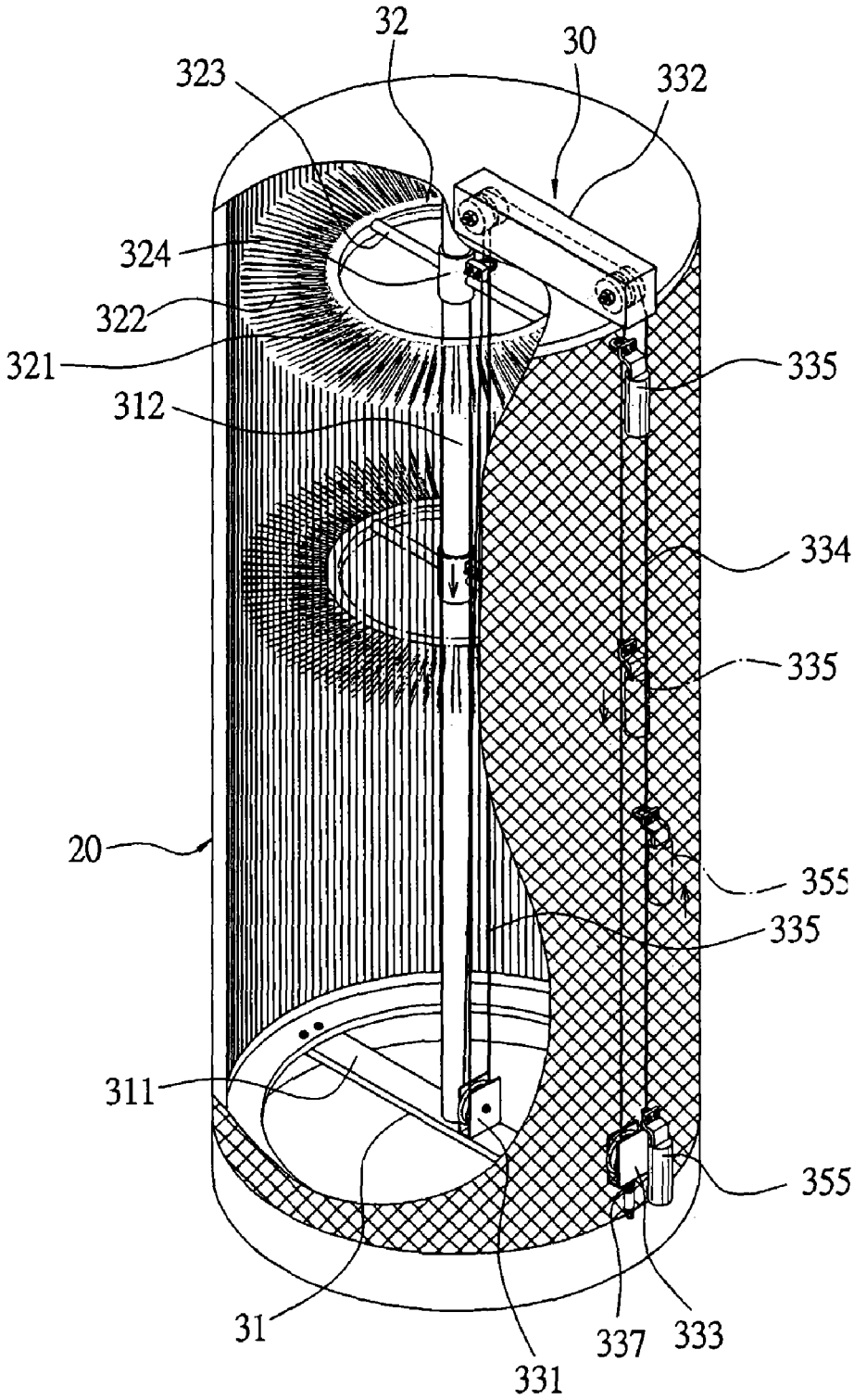
FIG. 8 is a perspective and cross-sectional view of the brush base of the dust-removing device in the present invention, indicating a condition of the brush base moving up and down.

In operating, a user has two hands respectively holding the two handles 335 respectively positioned at the upper and the lower end of the dust-collecting tank 20. Then, move downward the upper handle 335 (the first handle) and the pull rope 334 will actuate the brush base 32 to slide downward along the central guide rod 312, as shown in FIG. 8, and at this time the lower handle 335 (the second handle) is moved to an upper position together with the pull rope 334. Then, the second handle 335 is moved downward to actuate the brush base 32 to move upward to its original position, accordingly finishing one round of process of cleaning the dust-collecting tank 20. Thus, by moving the two handles 335 up and down alternately and repeatedly, the dust-collecting tank 20 can conveniently and quickly be cleaned up by the brushing bristles 322 of the brush base 32.

While the preferred embodiment of the invention has been described above, it will be recognized and understood that various modifications may be made therein and the appended claims are intended to cover all such modifications that may fall within the spirit and scope of the invention.

I claim:

1. A dust-removing device for a dust-collecting tank of a dust-collecting machine comprising a dust-collecting tank having an outer frame and a filter tank installed inside said outer frame, said filter tank made integral of filter paper, said outer frame is formed with a combining base at a bottom thereof, said filter tank having an inner circumferential wall formed with numerous serrated folds, among said serrated folds are formed numerous conical folded grooves, said dust-removing device installed in said dust-collecting tank, said dust-removing device comprising:

a guide frame having a horizontal supporter and a vertical central guide rod, said supporter having opposite ends respectively secured at two corresponding sides of an opening of said combining base under said dust-collecting tank, said central guide rod having a lower end disposed at a central portion of said horizontal supporter, said central guide rod having an upper end fixed to a central portion of a top wall of said dust-collecting tank:

a brush base having an outer circumferential edge formed with numerous brushing bristles, said brushing bristles reaching said folded grooves in the inner wall of said filter tank, said brush base has a toggle in a center thereof, said toggle is mounted on said central guide rod and able to move up and down along said guide rod, said brush base together with said brushing bristles is actuated to move up and down to carry out cleaning the inner walls of said folded grooves: and a pull unit consisting of a lower pulley base, an upper pulley base, an outer pulley base, a pull rope and two handles, said lower pulley base positioned on said supporter of said guide frame, said upper pulley base disposed on a topside of said outer frame of said dust-collecting tank, said outer pulley base fixed at a preset location of the lower outer wall of said outer frame, said pull rope extending through said lower pulley base, upper pulley base, and outer pulley base, and having two opposing ends fastened to said brush base, said pull rope able to actuate said brush base to move up and down along central guide rod, said two handles respectively secured at a preset location of two lines of said pull rope exposed to the outer side of said dust-collecting tank, said two handles held and applied with a force by a user's hands to actuate said pull rope to move up and down: and, when cleaning said dust-collecting tank, said two handles are moved downward alternatively and repeatedly letter said pull rope actuate said brush base together with said brushing bristles able to quickly remove dust adhered to the inner wall of said dust-collecting tank, further comprising an extension spring having a first end connected to said outer pulley base and a second end connected to said combining base under said outer frame of said dust-collecting tank.

2. The dust-removing device for the dust-collecting tank of a dust-collecting machine as claimed in claim 1, wherein said outer pulley base is fixed at a preset location on the outer wall of said combining base under said dust-collecting tank.

3. The dust-removing device for the dust-collecting tank of a dust-collecting machine as claimed in claim 1, wherein said pull rope has one end fastened with said toggle of said brush base, and the other end extending downwardly passing through said lower pulley base and then moving upwardly passing through the top wall of said dust-collecting tank and said upper pulley base, said pull rope then extending downwardly along the outer wall of said dust-collecting tank to pass through said outer pulley base and then turned back to pass through said outer pulley base and then turned back and pulled upwardly along an original route passing through said upper pulley base, said pull rope is inserted in said dust-collecting tank and fastened with said toggle of said brush base.

4. The dust-collecting device for the dust-collecting tank of a dust-collecting machine as claimed in claim 1, wherein said lower pulley base and said outer pulley base are respectively provided with only one pulley, while said upper pulley base has two pulley units, said two pulley units are respectively installed at the opposite ends of the rectangular frame of said upper pulley base and respectively located near the top center and the circumferential edge of said dust-collecting tank for said pull rope to make a turn and pass therethrough, with each pulley unit has two coaxial pulleys respectively rotatable independently to enable said pull rope pulled back and forth thereon.

5. The dust-removing device for the dust-collecting tank of a dust-collecting machine as claimed in claim 1, wherein said two handles and said brush base are respectively provided with a rope locking base having a locking plate and a U-shaped rod, said locking plate is fixed with one of said handle and said toggle, said U-shaped rod having two ends inserted through said locking plate, an insert hole is formed between said U-shaped rod and said locking plate for said pull rope to pass therethrough and clamped firmly therein by two nuts urging and locking the two ends of said U-shaped rod.

* * * * *